United States Patent [19]

Gmür

[11] 4,320,615

[45] Mar. 23, 1982

[54] APPARATUS FOR THE AUTOMATIC FILLING OF BAGS AT THE DISCHARGE SPOUT OF A FILLING HOPPER

[75] Inventor: Bruno Gmür, St. Gall, Switzerland

[73] Assignee: Gebrueder Buehler AG, Uzwil, Fed. Rep. of Germany

[21] Appl. No.: 128,133

[22] Filed: Mar. 7, 1980

[30] Foreign Application Priority Data

Mar. 14, 1979 [CH] Switzerland ..... 2409/79

[51] Int. Cl.[3] ..... B65B 43/18; B65B 43/54

[52] U.S. Cl. ..... 53/67; 53/573; 53/386

[58] Field of Search ..... 53/573, 571, 386, 67, 53/64; 141/277, 275, 269, 314, 313

[56] References Cited

U.S. PATENT DOCUMENTS

| | | | |
|---|---|---|---|
| 2,810,999 | 10/1957 | Spriggs | 53/571 |
| 3,053,027 | 9/1962 | Frost | 53/571 |
| 3,430,409 | 3/1969 | Manfredonia et al. | 53/573 X |
| 3,498,020 | 3/1970 | Eppenberger | 53/571 X |
| 3,501,893 | 3/1970 | Peterson | 53/573 |
| 3,566,578 | 3/1971 | Thorne et al. | 53/573 X |
| 3,673,759 | 7/1972 | Ayres et al. | 53/573 X |
| 3,986,322 | 10/1976 | Taylor | 53/571 |
| 4,182,094 | 1/1980 | Lieder et al. | 53/571 X |

FOREIGN PATENT DOCUMENTS

| | | |
|---|---|---|
| 1222844 | 8/1966 | Fed. Rep. of Germany . |
| 2361037 | 2/1975 | Fed. Rep. of Germany . |
| 1224317 | of 0000 | United Kingdom . |
| 2017652 | of 0000 | United Kingdom . |

*Primary Examiner*—James F. Coan

*Attorney, Agent, or Firm*—Oblon, Fisher, Spivak, McClelland & Maier

[57] ABSTRACT

An apparatus for the automatic filling of bags at a discharge spout of a filling hopper wherein empty bags are stored in a bag magazine in a horizontal position, the apparatus including an attachment unit hub, a frame pivotably mounted on the hub, a suction device mounted on the frame for individually removing each bag from the bag magazine and for swinging the removed bag into an essentially vertical hanging position and including a drum having suction mechanism, a spreading mechanism mounted on the frame for opening a respective bag mouth, and a holding device for holding each bag mouth tightly against the discharge spout, wherein the drum is mounted on the frame for horizontal movement and for rotation about an axis parallel to the surface of the stored bags and for movement parallel to the longitudinal axis of the stored bags upon pivoting of the frame about the attachment unit hub, such that the drum is lowered towards the stored bags so that the suction mechanism seizes the respective topmost bag of the bag magazine near the mouth of the individual bag.

19 Claims, 8 Drawing Figures

2b

2c

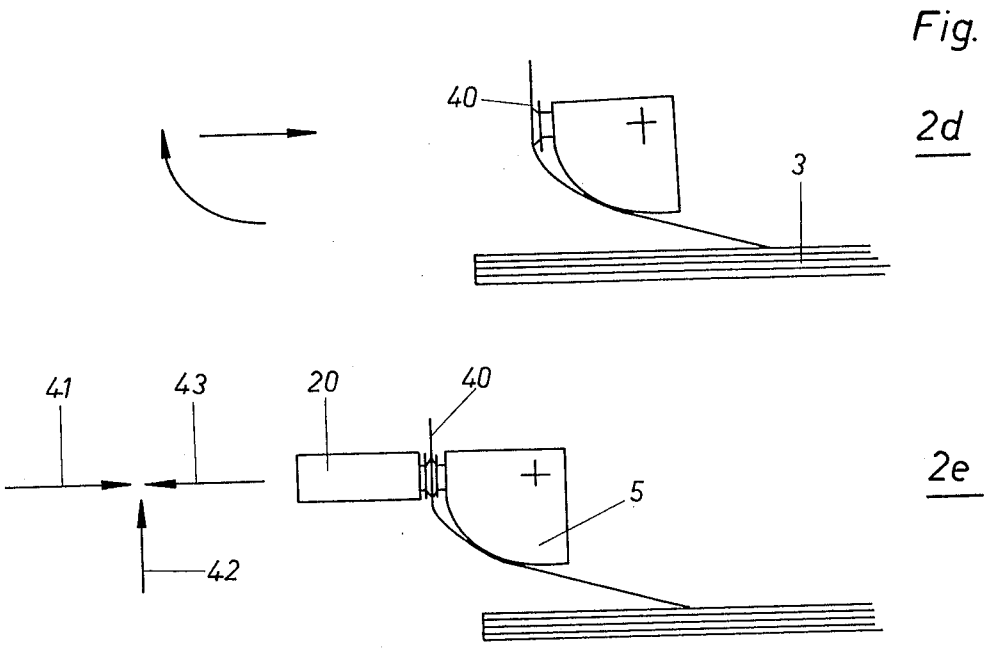
Fig.
2d
2e
3
40
5
40
20
43
42
41

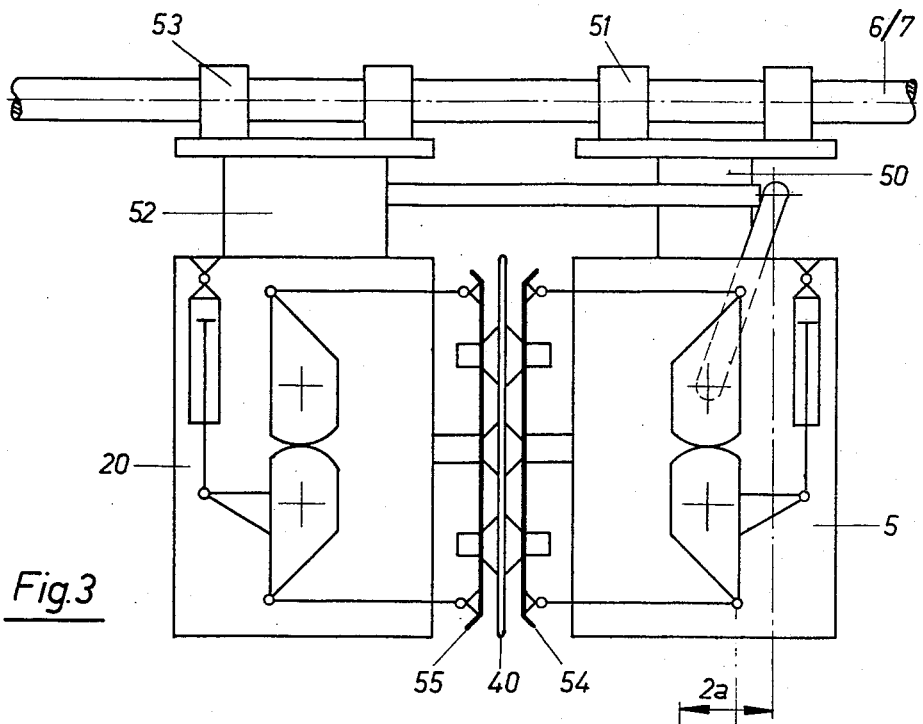
Fig.3
Fig.4
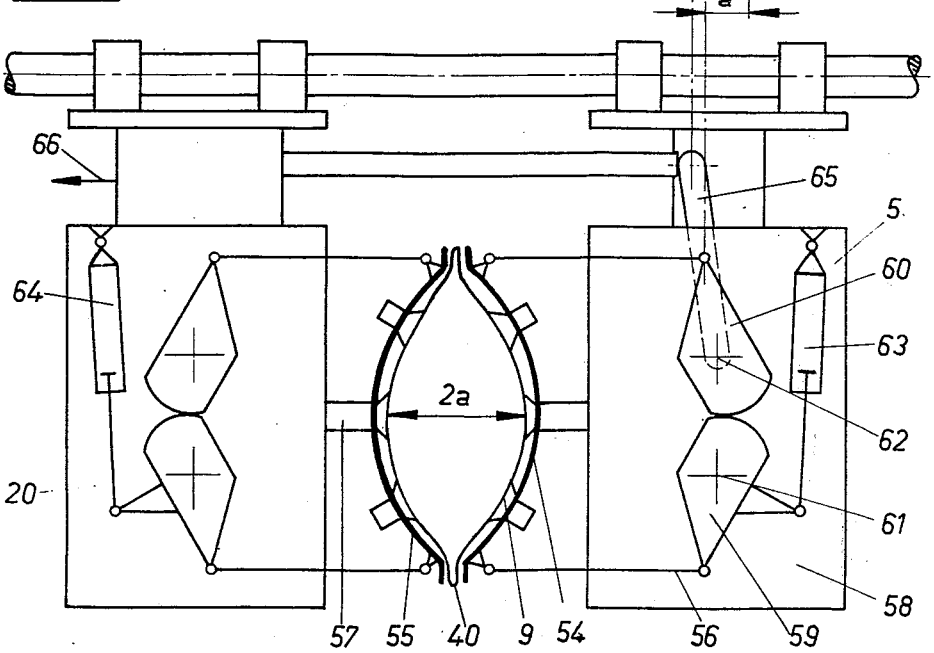

APPARATUS FOR THE AUTOMATIC FILLING OF BAGS AT THE DISCHARGE SPOUT OF A FILLING HOPPER

BACKGROUND OF THE INVENTION

1. Field of the Invention

The invention relates to an apparatus for the automatic filling of bags at the discharge spout of a filling hopper whereby the empty bags are horizontally stacked within a magazine, with a suction device to individually remove the bags from the bag magazine, swing the seized bag into an essentially vertical hanging position, with a spreading mechanism to open up the respective bag in the area of its opening, as well as a holding mechanism to clamp the bag opening to the discharge spout.

2. Description of the Prior Art

Fully automatic devices for the filling of bags, for instance bags made of paper, plastic or similar materials, have been known for some time. In a known apparatus (GB-Pat. No. 1 224 317) an empty bag is removed from a stack by means of a first pneumatic cylinder and a suction cup, it is then spread at the opening side by means of a second cylinder and swung, by means of an articulated axle in front of a filling spout. In doing so, the two sides of the bag must be held near the opening by two pairs of clamps, each holding the respective side of the bag. The apparatus of record is expensive and complicated in design and performs a large number of operations, whereby in addition, an interrelation of the individual operational steps is required: the starting position of the apparatus cannot be assumed until all individual operational steps have been completed.

In another bag-filling apparatus of the initially described type of record (DE-AS No. 23 61 037), the suction elements used for the withdrawal of the individual bags are attached to arms with an axle held on the frame which is in parallel arrangement to one of the two sides of the bag. The seized bag is first removed from its horizontal stacked position and placed into an essentially vertical position, is then grabbed by the suction elements in the area near its opening by the suction elements arranged at swinging arms, is then transferred into a position, swung by about 90° (vertical hanging position) and, at the same time is slipped over the discharge spout of the filling hopper. This makes it possible that the time sequence of the filling process is as long as the slowest of the individual operations and the original position may be reached before all individual steps have been completed. In this apparatus of record, however, the use of several moveable individual elements is necessary whereby the bag first removed from the stack must be transferred to another swinging device before it can reach the outlet spout of the filling hopper. This transfer of the seized bag from the pick-up device to an additional device to slip it over the discharge spout of the filling hopper may give rise to breakdowns in operation.

SUMMARY OF THE INVENTION

On the basis of the aforementioned, the invention proposes to improve an apparatus of this type in such a manner that further increased operational safety is achieved, that the number of swinging elements is reduced, while, simultaneously, the changes of position of the bag from the moment it is seized to the moment in which it is slipped over the discharge spout are kept to a minimum. In an apparatus of the initially described type, the invention achieves this by providing, as the suction mechanism for the individual removal of the bags from the bag magazine, a drum provided with adhesion mechanism in a horizontal sliding arrangement within a frame, rotatably held at an axis which is parallel to the surface of the bags stored within the bag magazine, as well as about an axis running at right angles to their longitudinal axis, and which may be lowered onto the bags in such a manner that the adhesion mechanism seize the topmost bag of the bag magazine in the area of the bag opening. The apparatus of the invention permits an especially safe, fully automatic operation, inasmuch as the bag is held by one device only while it is transferred from the bag magazine to the point where it is slipped over the discharge spout of the filling hopper, the device being the drum. In this operation, the bag travels a very short distance from its position on the top of the stack within the bag magazine to its position over the discharge spout of the filling hopper, and it is not necessary to make several swinging motions with the bag, the motions being at right angles to each other. All the steps necessary for the operation may essentially be performed within a minor angular twist of a drum (about one quarter turn) and small horizontal and vertical displacements and it is not necessary that bag on its way from the bag magazine to the discharge spout be handed from one device to one or several others. The simple motion does not only permit particularly fast operation but also provides for a remarkably simple control.

In a preferred embodiment of this invention, the drum, having been lowered towards the bags and having activated its adhesion device in order to lift the topmost bag at its opening, is twisted. During or subsequent to this twisting motion, preferably within an area of about 90°, the drum is lifted in order to effectively and quickly separate the topmost bag within the bag magazine from those stacked underneath. The preferred adhesion mechanism at the outside of the drum are pneumatic suction cups or similar devices. The function of the drum is as follows: The drum (adhesion drum) is lowered towards the bag in such a manner that the adhesion mechanism at the drum may seize the topmost bag in the area of its opening. When lowering the drum, the latter is lightly pressed against the stack of bags, the suction cups are activated, i.e. they are provided a partial vacuum, so that they remove with relatively great suction force the top bag from the stack. It is hereby recommended to distribute the adhesion mechanism at the outside of the drum across an area corresponding to the width of the bags to be picked up, whereby at least two to three suction cups should have to be activated. Thereafter, the drum with its suction cups and the now seized area of the bag opening is mechanically put into a rolling motion such that the open end of the bag is lifted at one side. It has been shown that with a rolling motion of this kind, especially whenever suction cups are distributed across the entire width of the bag, the entire bag thus seized is lifted and curved upward and detaches from the one lying beneath it. If a simultaneous or subsequent slight lifting of the drum ensures, which means an additional slight lifting of the bag, it is easily possible for air to enter between the two topmost bags, doing away with a possible sticking effect caused by humidity or similar influences. After the rolling motion, or immediately following the rolling motion, respectively, the drum moves the bag into a vertical position underneath the bag spout. Depending on the total length of the bag, it suffices to place only the top third of the bag into the vertical position. Subsequently, it is preferred that a clamping jaw, cooperating with the drum for the purpose of opening the seized bag approaches the bag hanging from the suction cups of the drum, again, preferably, in such a manner that drum and clamping jaw lightly compress the open end of the bag with slight pressure. The clamping jaw is provided with identical or similar adhesion mechanism as the drum. In order to achieve entirely trouble-free, uninterrupted, smoothly consecutive motions, it has been shown to be surprisingly effective if the adhesion mechanism at the drum as well as at the clamping jaw are attached to resilient leaf springs, whereby the latter may be connected to mechanical operating mechanism in such a manner that they may be given a bulging shape whereby the adhesion mechanism acting on the opening end of the bag from the side of the clamping jaw on the one hand, and from the drum side on the other, pull the opening of the bag apart and the bag opening is given an open, essentially oval shape. In this manner, the opening of the bag is achieved by a change of shape of the leaf springs at the clamping jaws and at the drum, and their attached suction cups, respectively (spreading). By means of an additional quick vertical motion the open bag may then be slipped over the bag spout which usually is designed in an oval shape. This is done so that the top rim of the bag comes to lie 5 to 10 cm higher than the lower edge of the spout.

In a preferred embodiment of the apparatus of the invention, drum and clamping jaws, subsequent to having performed the bag-opening operation, are brought into a lifted position, in which the opened top of the bag is slipped over the spout. It is advantageous to design the holding mechanism which attaches the open end of the bag to the discharge spout in such a manner that it becomes operable only after drum and clamping jaws have attained their lifted position.

The total sequence of motion of this apparatus is very flowing, without any jerking and this is particularly evident if the drum and the clamping jaws are activated by pneumatic devices, and by pneumatic cylinders in particular.

In order to ascertain a smooth opening of the bag during the opening operation, it is advantageous to provide a rigid connection between the activating mechanism for the drum and for the clamping jaws, i.e. to fasten the activating mechanism for the drum and for the clamping jaw rigidly in relation to each other, attaching them, for example, to the frame. It is equally important that the two leaf springs perform a synchronous motion during the opening phase.

In a preferred embodiment of the apparatus of the invention, a carousel arrangement of several discharge spouts revolving about a vertical axis, driven by a motor, is provided which, subsequent to clamping one bag to a discharge spout which is in charging position (filling position) is rotatable in such a manner that a new discharge spout advances into the discharge position. Preferrably, the revolving arrangement has four, five or six discharge spouts and has a polar-reversible motor to place it in the respective charging- or filling positions, respectively. It is of great advantage if the motor of the revolving spout arrangement can be switched to fast or slow speed, if it is provided with a brake, and if one of its phases has an added resistor (during the starting phase).

For the purpose of an additional improvement of the automatic operations of the apparatus of the invention, an optical control mechanism (detector) is attached to the adhesion drum by means of which the presence of a bag, the markings of a bag, if required, may be signalled to a central control and command unit.

The apparatus of the invention may advantageously be switched in such a manner that it prepares (seizes) a new bag simultaneously with the revolving arrangement positioning the spout to be used in its filling position.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein:

FIG. 2*a* to 2*e* are illustrations of the main motions during the seizing of the bag;

FIG. 3 is a top view of a device of the invention in a position according to FIG. 2*e;*

FIG. 4 is an illustration of the top view of the apparatus of the invention with an open bag immediately succeeding the position according to FIG. 2*e.*

DETAILED DESCRIPTION OF THE PREFERRED EMBODIMENTS

Figure 1:
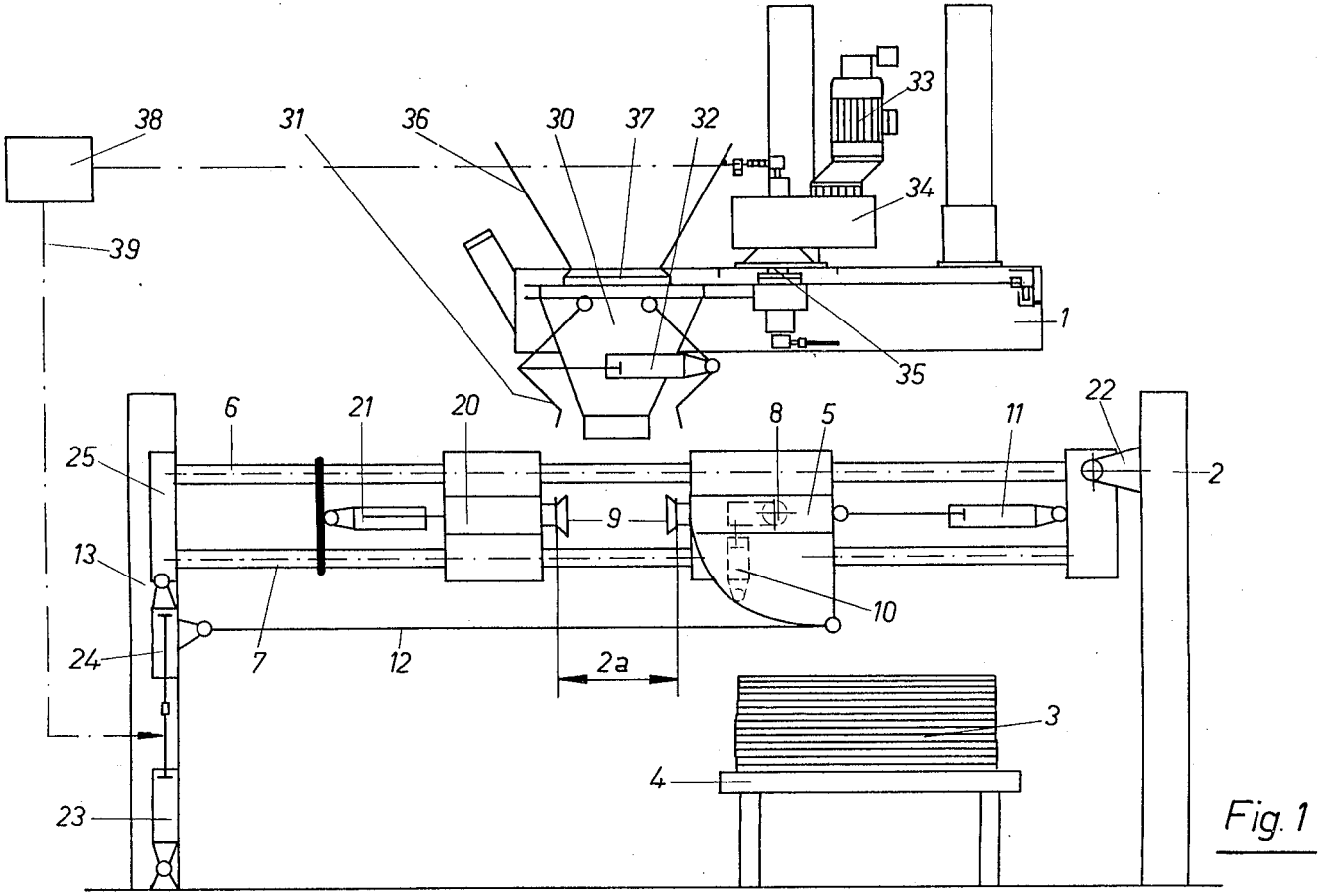
FIG. 1 is a view of the entire apparatus of the invention.
Figure 2A:
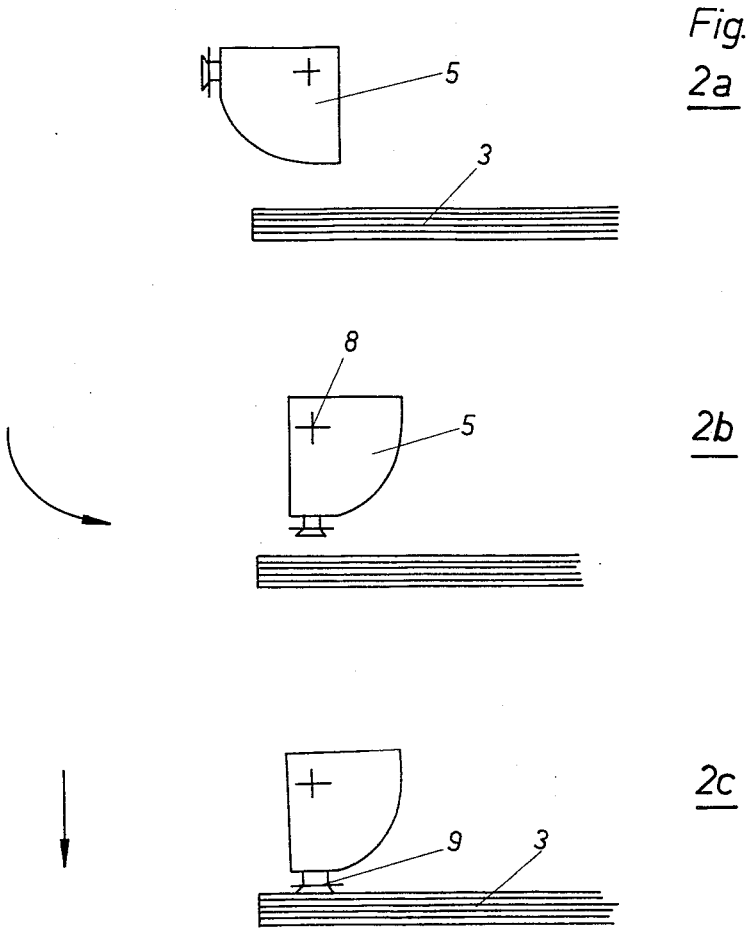

The apparatus as shown in FIG. 1 is a revolving arrangement 1 with an automatic bag attachment 2. A stack of bags 3 is stored on a (sketched) table 4, an adhesion drum 5 being held within guide columns 6 and 7 above the table. The drum 5 has a hub 8 and suction cups 9 and is rotatable about its hub by means of a pneumatic cylinder 10. The horizontal motion of the drum 5 is triggered by an pneumatic cylinder 11, the cylinder being held in an articulated bearing at a cross beam of the guiding columns 6 and 7. The drum 5 is connected to the vertical engine frame 13 by means of a pull chain 12, making a smooth rolling motion during the lifting of the bag in positions of FIG. 2*c* to FIG. 2*d* possible. In addition, a clamping jaw 20 is provided which is horizontally and moveably arranged at the guiding columns 6 and 7, horizontally above the pneumatic cylinder 21, the cylinder also being held at the cross beam of the guiding columns 6 and 7. The clamping jaw 20 has suction cups 9, affixed so as to be identical to those at the drum 5.

The entire unit of the guiding columns 6 and 7 with the drum 5 and the clamping jaw 20 may be lowered and raised about a hub 22, by means of the pneumatic cylinders 23 and 24. An end plate 25 is arranged in a semi-circle within a corresponding track of the engine frame 13.

A spout 30 is shown at the revolving arrangement 1 (FIG. 1), having a clamping device 31 which can be opened and closed by means of a pneumatic cylinder 32. The illustration of the revolving arrangement 1 in FIG. 1 is merely sketched and is shown on a reduced scale as compared with the illustration of the lower automatic bag attachment 2, the exact position of the two devices having been turned into the plane of the illustration.

The revolving arrangement 1 has a drive motor 33 and a gear 34, both being directly attached to the revolving arrangement 1 in such a manner that the transfer shaft 35 of the gear 34 forms the rotational axis of the revolving arrangement.

The material to be filled into the bags, for instance, flour, is taken through a hopper 36 in the opening 37 into the discharge spout 30 and from there is directly fed into the bag attached to the spout. In order to be able to coordinate all operations of the revolving arrangement 1, the clamping device 31 and the automatic bag attachment 2 in the best possible manner, all important control impulses come from a central control unit 38 by way of corresponding lines 39.

The sequence of motions of the drum 5 are shown in FIGS. *2a* to *2e*, whereby FIG. *2a* shows the initial position of the adhesion drum 5 relative to the stack of bags 3.

In the position as shown in FIG. *2b*, the adhesion drum 5 has performed a 90° rotation about hub 8, the motion having been initiated by cylinder 10. Drum 5 with suction cups 9 is caused by cylinder 23 to be lowered to the stack of bags 3, together with the guide columns unit 6 and 7, turning about hub 22. The suction cups 9, by their partial vacuum, suck up the topmost bag, e.g. a paper bag or a plastic bag.

FIG. *2d* shows how the adhesion drum 5 subsequently performs a clockwise 90° rotation, triggered by cylinder 11, pulling the adhesion drum 5 towards the back. This forces the pull chain 12 which lies coiled about the adhesion drum 5 to perform a steady motion. During this portion of the motion, the other end of the bag 40 is not displaced.

In the position shown in FIG. *2e*, the upper edge of bag 40 has been brought into a vertical position. The sequence of the motion is shown in FIG. *2e*. The sequence is as follows: Clamping jaw 20 is pushed towards the right as indicated by arrow 41; then the entire unit is lifted by cylinder 23 (arrow 42). Then follows a horizontal closing, or leftward motion of the adhesion drum 5 (arrow 43).

The illustration of FIG. *2e* shows the latter phase, whereby clamping jaw 20 and adhesion drum 5 are gripping the bag. The suction cups 9 of the clamping jaw 20 now also are given a partial vacuum. This is the initial position of the apparatus as shown in FIG. 3 in a top view and in somewhat enlarged a scale.

FIG. 3 also indicates that the drum 5 is also held at the guiding columns 6 and 7 by supports 50 and by movable bearings 51. The clamping jaw 20 also is held moveably at the guiding columns 6 and 7, by means of a support 52 and a bearing 53.

FIG. 4 shows the identical apparatus of FIG. 3, but in the following phase of motion: the suction cups 9 at the drum 5 as well as at the clamping jaw 20 are attached to elastic leaf springs 54 and 55, respectively. These leaf springs are held by means of pressure rods 56, attached to the respective outer ends of the leaf springs. The leaf springs 54 and 55 are, in addition, held by a bracket 57 in the middle, so that each spring is held at three points. The drive mechanism 58 has two toothed quadrants 59 and 60 which mesh and ensure the simultaneous operation of the two leaf springs. The toothed quadrants 59 and 60 are held at about their centers in rotation points 61 and 62 in the drum 5. The same applies to the clamping jaw 20. The toothed quadrants 50 and 60 are activated by a pneumatic cylinder 63, 64, respectively. Thereby, the cylinder 63, by way of the toothed quadrants 59 and 60 and a lever arrangement 65 moves the clamping jaw 20 towards the left by the distance *2a* (Arrow 66). Simultaneously, cylinder 64 comes under pressure and moves the ends of the leaf spring towards the right, by means of the corresponding toothed quadrants, so that the bag 40 remains clamped between the ends of the leaf springs at its lateral edges, while the opening of the bag assumes an approximately oval shape when seen from the top (special reference is made here to the shape of the opening as shown in FIG. 4). During the process, cylinder 21 remains under pressure, but it slows, because of its reduced power, the horizontal motion of the clamping jaw 20 in the direction of arrow 66.

As can be seen from FIG. 1, the entire unit (guiding columns 6, 7 and 8, drum 5 and clamping jaw 20 with the opened bag 40) may be lifted about the hub 22 by means of cylinder 24, whereby the upper edges of the bag slip between the discharge spout 30 and the holding device 31. The holding device 31 then holds the bag 40 tightly against the discharge spout 30. Then, the vacuum at the suction cups 9 is removed, the entire unit descends under the influence of cylinder 24 into its starting position and a new cycle of motions can commence. With the present invention, therefore, the device for the individual withdrawal of bags from the bag magazine may (simultaneously) grip a new bag, or prepare it for filling, respectively, while the revolving arrangement 1 still is moving the newly to be activated discharge spout 30 into its discharge- or readiness position.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for the automatic filling of bags at a discharge spout of a filling hopper wherein a plurality of empty bags are stored in a bag magazine in a horizontal position, said apparatus comprising:

an attachment unit hub;

a frame pivotably mounted on said hub;

a suction device mounted on said frame for individually removing each bag from said bag magazine and for swinging the removed bag into an essentially vertical hanging position and including a drum having suction means;

a spreading mechanism mounted on said frame for opening the bag mouth of each of said removed bags; and a holding device for holding each bag mouth tightly against said discharge spout, wherein said drum is mounted on said frame for horizontal movement, for rotation about an axis parallel to the surface of said stored bags and for movement parallel to the longitudinal axis of said stored bags upon pivoting of said frame about said attachment unit hub, such that said drum is lowered towards said stored bags so that said suction means causes removal of the respective topmost stored bag near each said bag mouth.

2. An apparatus as claimed in claim 1, further comprising rotating means for rotating said drum so that said drum lifts the mouth end of said topmost bag after said drum is lowered towards said stored bags.

3. The apparatus as claimed in claim 2, further comprising lifting means for lifting said suction device during or after rotation of said drum.

4. The apparatus as claimed in claim 2 or 3, wherein said rotating means further comprises means for rotating said drum approximately 90°.

5. The apparatus as claimed in claim 1 or 2 or 22 further comprising a clamping jaw cooperating with said drum for opening said mouth of said removed bag, said clamping jaw movably mounted on said frame for contacting said drum, and having suction means for gripping a side of the bag mouth of said removed bag facing away from said drum.

6. The apparatus as claimed in claim 5, wherein said suction means comprise suction cups.

7. The apparatus as claimed in claim 6, further comprising a plurality of inserted leaf springs, wherein said suction cups are attached to both said clamping jaw and said drum by said plurality of inserted leaf springs.

8. The apparatus as claimed in claim 5, wherein said suction means of said drum and of said clamping jaw are arranged across a width corresponding to the width of said bags.

9. The apparatus as claimed in claim 7, further comprising a plurality of activating elements attached to said leaf springs, wherein said leaf springs are moved into an essentially oval-shaped position by means of said activating elements.

10. The apparatus as claimed in claim 5, further comprising means for lifting said drum and said clamping jaw, wherein, upon opening said mouth of said removed bag, said drum and said clamping jaw are lifted into an upper lifted position and guide each said open bag mouth over said discharge spout.

11. The apparatus as claimed in claim 10, wherein said holding device for holding said bag mouth against said discharge spout further comprises means for operating only after said drum and said clamping jaw have reached the upper lifted position.

12. The apparatus as claimed in claim 9, further comprising pneumatic operating means for operating said drum and said clamping jaw.

13. The apparatus as claimed in claim 12, wherein said pneumatic operating means further comprises a plurality of pneumatic cylinders.

14. The apparatus as claimed in claim 13, further comprising means for oppositely fastening said plurality of pneumatic operating means for said drum and for said clamping jaw relative to each other to said frame in a rigid arrangement.

15. The apparatus as claimed in claim 1, further comprising at least a first and second discharge spout, a filling position, and means for revolving on a vertical axis said at least first and second discharge spout, wherein subsequent to holding said bag against said first discharge spout in said filling position, said means for revolving rotates in such a manner that said second discharge spout reaches said filling position.

16. The apparatus as claimed in claim 15, further comprising a polar-reversible motor wherein said means for revolving further comprises a third discharge spout and wherein said means for revolving is rotated by means of said polar reversible motor.

17. The apparatus as claimed in claim 16, further comprising means for operating said motor at fast and slow speeds, wherein said motor is operated by said operating means.

18. The apparatus as claimed in claim 17, wherein said motor further comprises a brake and an added resistor for one of the motor phases.

19. The apparatus as claimed in claim 2, further comprising an optical detector for determining the time of removal of said bag by said drum.

* * * * *